US011185156B2

(12) United States Patent
Yang

(10) Patent No.: US 11,185,156 B2
(45) Date of Patent: Nov. 30, 2021

(54) TABLE STRUCTURE THAT ALLOWS FOLDING TABLES TO BE EXPANDED AND STABLY COMBINED

(71) Applicant: J.Y.MONTAGE TRADE INDUSTRY CO., LTD., Changhua County (TW)

(72) Inventor: Chih-Shun Yang, Changhua County (TW)

(73) Assignee: J.Y.MONTAGE TRADE INDUSTRY CO., LTD., Changhua Country (TW)

( * ) Notice: Subject to any disclaimer, the term of this patent is extended or adjusted under 35 U.S.C. 154(b) by 0 days.

(21) Appl. No.: 17/100,032

(22) Filed: Nov. 20, 2020

(65) Prior Publication Data

US 2021/0153642 A1 May 27, 2021

(30) Foreign Application Priority Data

Nov. 21, 2019 (JP) ..... JP2019-004420

(51) Int. Cl.
*A47B 3/083* (2006.01)
*A47B 3/00* (2006.01)
*A47B 3/08* (2006.01)

(52) U.S. Cl.
CPC ..... *A47B 3/083* (2013.01); *A47B 3/002* (2013.01); *A47B 3/0809* (2013.01); *A47B 2200/004* (2013.01); *A47B 2200/005* (2013.01)

(58) Field of Classification Search
CPC ..... A47B 3/002; A47B 3/083; A47B 3/0809; A47B 2200/004; A47B 2200/005
See application file for complete search history.

(56) References Cited

U.S. PATENT DOCUMENTS 4,653,804 A * 3/1987 Yoo ..... A47B 3/14 108/160
4,841,877 A * 6/1989 Virtue ..... A47B 3/0912 108/167
5,009,170 A * 4/1991 Spehar ..... A47B 3/10 108/132

(Continued)

FOREIGN PATENT DOCUMENTS

FR 2573467 A1 * 5/1986 ..... E05C 9/045
JP 1980-116529 2/1979

(Continued)

OTHER PUBLICATIONS

JP technical search report issued in the JP Application No. 3225337 dated Oct. 20, 2020, 3 pages.

*Primary Examiner* — Matthew W Ing

(57) ABSTRACT

Described herein is a foldable table capable of being expanded and stably folded. The foldable table includes a table top plate; two matching frames, each including a first frame and a second frame; and two foldable table legs, each including a first support member and a second support member. Each of the first support member and the second support member includes a U-shaped bolt and a spring drum for combining with the two support members. The support member design including the U-shaped bolt and the spring drum allow the foldable table to be expanded without using excessive force. The table top plate includes a first plate body and a second plate body, each of which includes a joint portion, which allows the table to be stably folded.

10 Claims, 7 Drawing Sheets

(56) References Cited

U.S. PATENT DOCUMENTS

| | | | | |
|---|---|---|---|---|
| 6,058,853 | A * | 5/2000 | Pinch | A47B 3/087 108/129 |
| 7,441,813 | B2 * | 10/2008 | Qin | H04B 1/3883 292/163 |
| 9,848,695 | B1 | 12/2017 | Gauss | |
| 2011/0249850 | A1 * | 10/2011 | Davis | H04R 25/02 381/328 |
| 2017/0052217 | A1 * | 2/2017 | Zhang | G01R 31/44 |
| 2017/0370668 | A1 * | 12/2017 | Locher | F41A 17/46 |

FOREIGN PATENT DOCUMENTS

| | | | |
|---|---|---|---|
| JP | 2015-2942 | A | 1/2015 |
| KR | 20-2015-0004278 | A | 11/2015 |
| TW | M576002 | | 4/2019 |

* cited by examiner

TABLE STRUCTURE THAT ALLOWS FOLDING TABLES TO BE EXPANDED AND STABLY COMBINED

PRIORITY CLAIM AND CROSS-REFERENCE

The instant application claims priority from JP3225337, the entirety of which is hereby incorporated herein by reference.

TECHNICAL FIELD

The instant disclosure is directed to a foldable table, particularly to a foldable table having a structure that allows the folding table to be expanded and stably combined, or folded.

BACKGROUND

Referring to Republic of China (Taiwan) Utility Model Patent No. M576002 for a conventional folding table structure. Also, refer to instant FIGS. 1 and 2 for explanations of the same conventional folding table structure.

Referring to FIGS. 1 and 2, the conventional folding table structure includes a table top plate 10', two folding frames 20', and two support units 30'. The table top plate 10' is composed of two symmetrical aluminum rectangular plates 11'. The back surfaces of the two rectangular plates 11' are provided with convex ribs 13' corresponding to each other on a proximal side and a distal side, respectively. The two folding frames 20' are provided on the back surface of the table top plate 10', each of which extends across the two rectangular plate bodies 11'. Each of the two folding frames 20' includes a first iron piece 21' and a second iron piece 22' for folding. Each of the first iron piece 21' and the second iron piece 22' has a substantially right-triangular shape, and the two iron pieces are pivotally contacted with each other by a rotation shaft portion 23' at the vertices of the two right-angled portions. The first iron piece 21' is provided with an L-shaped inner folding side plate 211' on a horizontal side of the right-angled portion, and the inner folding side plate 211' has a long position-limiting groove 212' on a vertical surface thereof. Similarly, the second iron piece 22' is provided with an L-shaped outer folding side plate 221' on the horizontal side of the right-angled portion. The outer folding side plate 221' and the inner folding side plate 211' are on the same horizontal side. The outer folding side plate 221' has a long position-limiting groove 222' provided on a vertical surface thereof. Position-limiting sliding sides 213' and 223' are extended vertically to the opposite ends from the horizontal sides of the first iron piece 21' and the second iron piece 22', respectively. An L-shaped inner top plate 214' is provided on a diagonal top end of the first iron sheet 21' facing the inner folding side plate 211'. The inner top plate 214' is provided with a short position-limiting groove 215' facing the long position-limiting groove 212'. The top end 216' of the inner top plate 214' abuts against the rib 13' on the inner side of the bottom surface of the rectangular plate 11'. The inner top plate 214' forms an oblique guide edge 217' from the top end 216' to the other end. A position-limiting plate 218' is further provided at the top of the first iron sheet 21' adjacent to the inner top plate 214'.

Two supporting units 30' are respectively assembled and arranged between the first and second iron sheets 21' and 22' of the two folding brackets 20'. Both supporting units 30' have a first leg 31' and a second leg 32'. The first and second legs 31', 32' are both formed by bending metal strips to a U shape, having first standing rods 311', 321' and a second standing rods 312', 322'. The first standing rods 311', 321' and the second standing rods 312', 322' are of different lengths and are located on different planes. The first standing rod 311' of the first leg 31' is the same length as the second standing rod 322' of the second leg 32'. The second standing rod 312' of the first leg 31' is the same length as the first standing rod 321' of the second leg 32'. The first standing rods 311', 321' connect with combination connecting rods 313', 323' in directions extending toward the second standing rods 312', 322'. The second standing rods 312', 322' connect with combination sleeves 314', 324' in directions extending toward the first standing rods 311', 321'. As such, the first standing rod 311' of the first leg 31' is sleeved on the combination sleeve 324' of the second standing rod 322' of second leg 32' via the combination connecting rod 313', and the first standing rod 321' of the second leg 32' is sleeved on the combination sleeve 314' of the second standing rod 312' of the first leg 31' via the combination connecting rod 323'. These elements are therefore configured to be combined to form a chevron-shaped support unit which has deformable elasticity of inward compression and outward elasticity.

Because, in the above-mentioned folding table structure, the combination of the first leg 31' and the second leg 32' must be sleeved on the combination sleeves 314', 324' through the combination connecting rods 313', 323', respectively, the assembly and disassembly are not easy and the components need to be made with different materials and processes, which is time-consuming and costly. Furthermore, because the assembly needs to be done with different materials, there is no other assisting force when expanding and folding, resulting in the need for greater force to fold or expand the table. In addition, the outer side of the table top plate 10' is provided with the rib 13', such causes instability and inconvenience when combining the table.

SUMMARY

To address the above issues observed by the instant inventor, a table structure that allows folding tables to be expended and stably folded is proposed. In the table structure, the first support member and the second support member are made of one piece having the same or roughly similar shapes. As such, the support members are able to be easily manufactured with reduced manufacturing and material costs. Furthermore, the combination of the first support member and the second support member is done by inserting a first U-shaped bolt into a second spring drum, and inserting the second U-shaped bolt into the first spring drum, which is convenient for assembly and disassembly. In addition, the elastic force of the first spring sleeve relative to the second U-shaped bolt and the elastic force of the second spring sleeve relative to the first U-shaped bolt is able to be harnessed such that the table is capable of being easily expanded. Furthermore, the bottom of the first elastic C-shaped main body, the bottom of the second elastic C-shaped main body, and the first U-shaped bolt inserted into the second spring drum and the second U-shaped bolt inserted into the first spring drum to form a three-point stabilization, thereby achieving a stable structure when the table is expanded.

In addition, by setting the first joint portion of the first plate body and the second joint portion of the second plate body, the first joint portion and second joint portion of the table structure are able to combine with each other by, for example, embedding.

To achieve the above goal, the instant application provides a table structure that allows folding tables to be expanded and stably folded. The table structure includes: a table top plate, a first plate body, and a second plate body. The first plate body and the second plate body are connected to each other and able to be folded in relative to each other. The first plate body and the second plate body are substantially rectangular such that both the first plate body and the second plate body have two shorter sides and two longer sides. One of the longer sides of the first plate body is arranged closed to one of the longer sides of the second plate body. The table structure further includes two matching frames arranged adjacent to the shorter sides of the first plate body and the second plate body. The two matching frames include a first frame and a second frame, which are arranged below the first plate body and the second plate body, respectively. The first frame has a first retaining groove adjacent to the shorter sides of the first plate body, and the second frame has a second retaining groove adjacent to the shorter sides of the second plate body. The table structure further includes two foldable table legs corresponding to the two matching frames such. Each of the foldable table legs includes a first support member and a second support member. The first support member includes a first U-shaped bolt, a first elastic C-shaped main body, and a first spring drum formed integrally in this sequence. The second support member includes a second U-shaped bolt, a second elastic C-shaped main body, and a second spring drum formed integrally in this sequence. The first elastic C-shaped main body pierces the first retaining groove of the first frame such that the first U-shaped bolt and the first spring drum are adjacent to configurations at a location where the longer sides of the first plate body and the second plate body meet. The second elastic C-shaped main body pierces the second retaining groove of the second frame such that the second U-shaped bolt and the second spring drum are adjacent to configurations at a location where the longer sides of the first plate body and the second plate body meet. The first U-shaped bolt is inserted into the second spring drum, and the second U-shaped bolt is inserted into the first spring drum.

When the table structure is in an expanded state, the first plate body and the second plate body are on the same plane. The first elastic C-shaped main body of the first support member of each foldable table leg leans against the first retaining groove obliquely away from the end of the connection between the first plate body and the second plate body. Similarly, first elastic C-shaped main body of the second support member of each of the foldable table legs leans against the second retaining groove obliquely away from the connection between the first plate body and the second plate body. The elastic force between the first spring drum and of the second U-shaped bolt and the elastic force between the second spring drum and the first U-shaped bolt assists the expansion of the table. The lower portion of the first elastic C-shaped main body, lower portion of the second elastic C-shaped main body, as well as the first U-shaped bolt inserted in the second spring drum and the second U-shaped bolt inserted in the first spring drum result in three-point stabilization.

When the table structure is in a folded state, the first plate body folds close to the second plate body. The first elastic C-shaped main body moves toward the first retaining groove adjacent to the junction of the first plate body and the second plate body. The entirety of the first elastic C-shaped main body is close to the first plate body. The second elastic C-shaped main body moves toward the second retaining groove adjacent to the junction of the first plate body and the second plate body. The entirety of the second elastic C-shaped main body is close to the second plate body. The first support member and the second support member are located between the first frame and the second frame, as well as between the first plate body and the second plate body.

In some embodiments, the first plate body includes a first joint portion at the longer side thereof away from the connection with the second plate body, and the second plate body includes a second joint portion at the longer side thereof away from the connection with the first plate body. The first joint portion and the second joint portion are able to join with each other so that the table is folded.

In some embodiments, the first joint portion and the second joint portion are configured to join with each other in a coalescing manner.

In some embodiments, the first frame is substantially triangular. The first retaining groove is configured on a longer leg of the first frame. The shorter leg of the first frame is adjacent to the connections between the first plate body and the second plate body. The hypotenuse of the first frame is configured with a retaining block configured to retain the first C-shaped main body of the first support member.

In some embodiments, the first frame has a position limiting cutout adjacent to where the first U-shaped bolt inserted into the second spring drum. The first elastic C-shaped main body passes through the position limiting cut-out so that the movement of the first elastic C-shaped main body is limited by the position limiting cut-out.

In some embodiments, the location where the first U-shaped bolt inserting in the second spring drum is arranged far from the shorter sides of the first plate body and the second plate body. The location where the second U-shaped bolt inserting in the spring drum is arranged close to the shorter sides of the first plate body and the second plate body.

In some embodiments, the first elastic C-shaped main body of the first support member includes a first upper portion, a first connector portion, and a first lower portion. The first upper portion is arranged close to the first plate body. Two ends of the first connector portion are angularly connected to the first upper portion and the first lower portion. The end of the first upper portion distal to the connection with the first connector portion is connected to the first U-shaped bolt. The first U-shaped bolt extends downward from the first upper portion, such that the first U-shaped bolt is substantially perpendicular to a lower surface of the first plate body. The end of the first upper portion adjacent to the connection with the first connector portion passes through the first retaining groove, and in the unfolded state, lean against the end of the first retaining groove further away from the connection between the first plate body and the second plate body. The end of the first lower portion away from the connection with the first connector portion is connected to the first spring drum. The first spring drum extends upward from the first lower portion, such that the first spring drum is substantially perpendicular to the lower surface of the first plate body. The first upper portion passes through the position limiting cut-out at a location adjacent to the first U-shaped bolt.

In some embodiments, the second elastic C-shaped main body of the second support member includes a second upper portion, a second connector portion, and a second lower portion. The second upper portion is arranged close to the second plate body. Two ends of the second connector portion are angularly connected to the second upper portion and the second lower portion. The second upper portion is connected to the second U-shaped bolt at an end away from the connection with the second connector portion. The second U-shaped bolt extends downward from the second upper portion, such that the second U-shaped bolt is substantially perpendicular to a lower surface of the second plate body. The end of the second upper portion adjacent to the connection with the second connector portion passes through the second retaining groove, and leans obliquely against the end of the second retaining groove away from the connection between the first plate body and the second plate body when the table is expanded. The end of the second lower portion away from the second connector portion is connected to the second spring drum. The second spring drum extends upward from the second lower portion, such that the second spring drum is substantially perpendicular to the lower surface of the second plate body.

In some embodiments, when viewing from the bottom plan view, when the table is in expanded state, the first upper portion and the first lower portion of the first support member cross each other, and the second upper portion and the second lower portion of the second support member do not cross.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
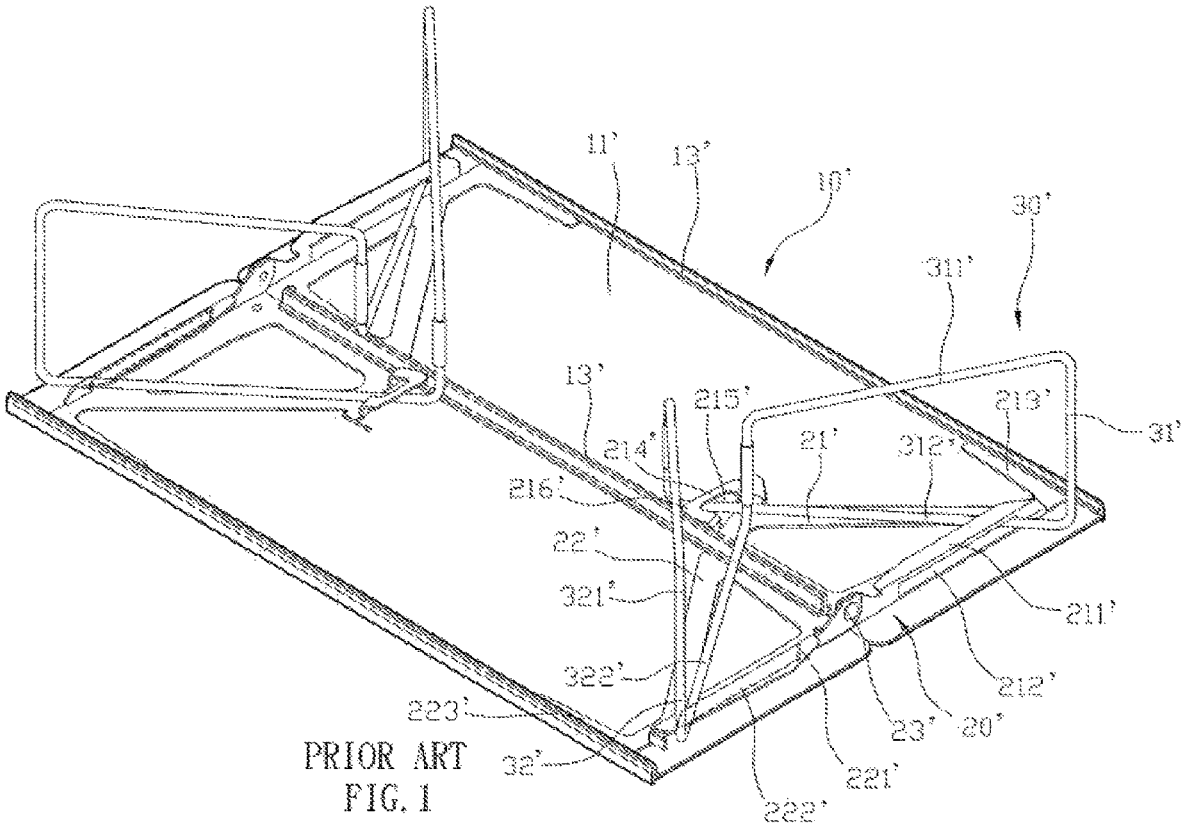
PRIOR ART FIG. 1
FIG. 1 is a three-dimensional schematic of a folding table as described in some references.
Figure 2:
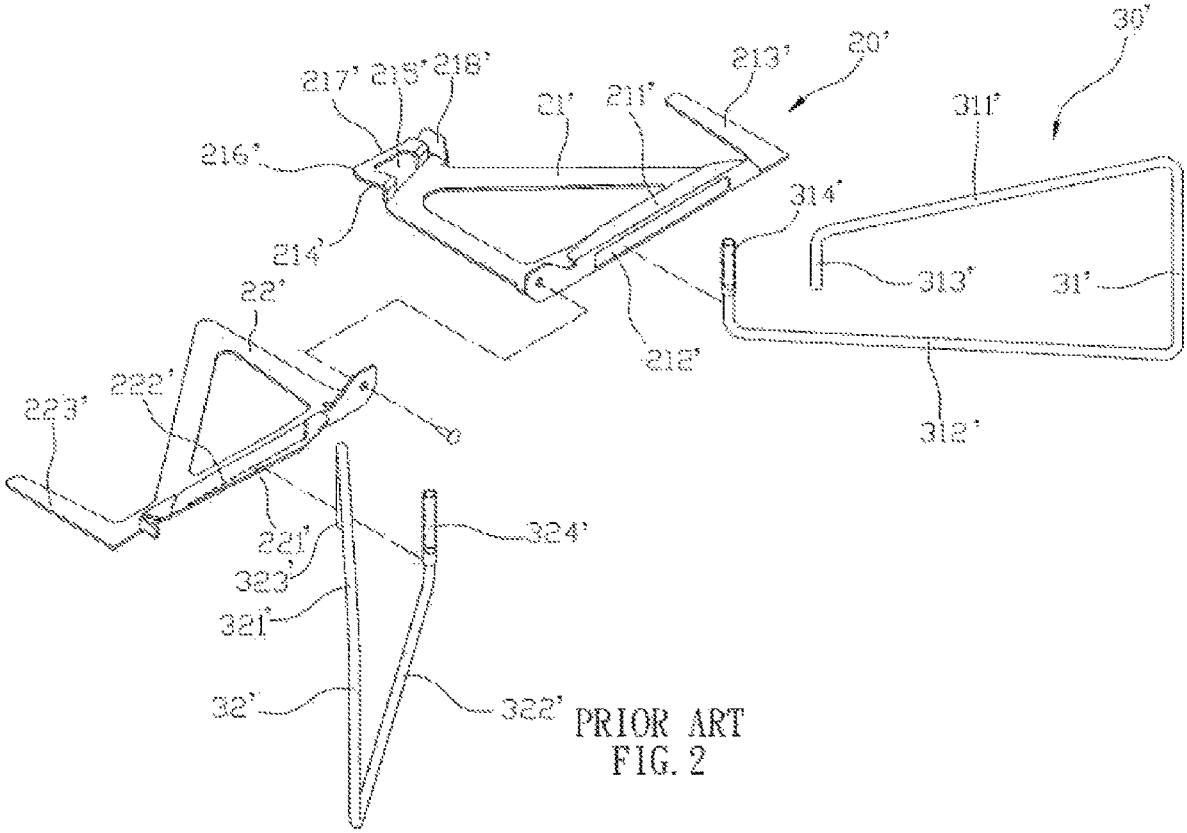
PRIOR ART FIG. 2
FIG. 2 is a partial enlarged and exploded schematic diagram of the folding bracket and the supporting unit of a folding table as described in some references.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Referring to FIGS. 3-7, the instant specification, in some embodiments, describes a table structure that allows folding tables to be expanded and stably folded. In some embodiments, the table 100 includes a table top plate 1, two matching frames 2 and two foldable table legs 3.

The table top plate 1 includes a first plate body 11 and a second plate body 12 that are connected to each other and can be folded in relative to each other. The first plate body 11 and the second plate body 12 are substantially rectangular, having two longer sides and two shorter sides. One of the longer sides of the first plate body 11 and one of the longer sides of the second plate body 12 are arranged close to each other.

Figure 7:
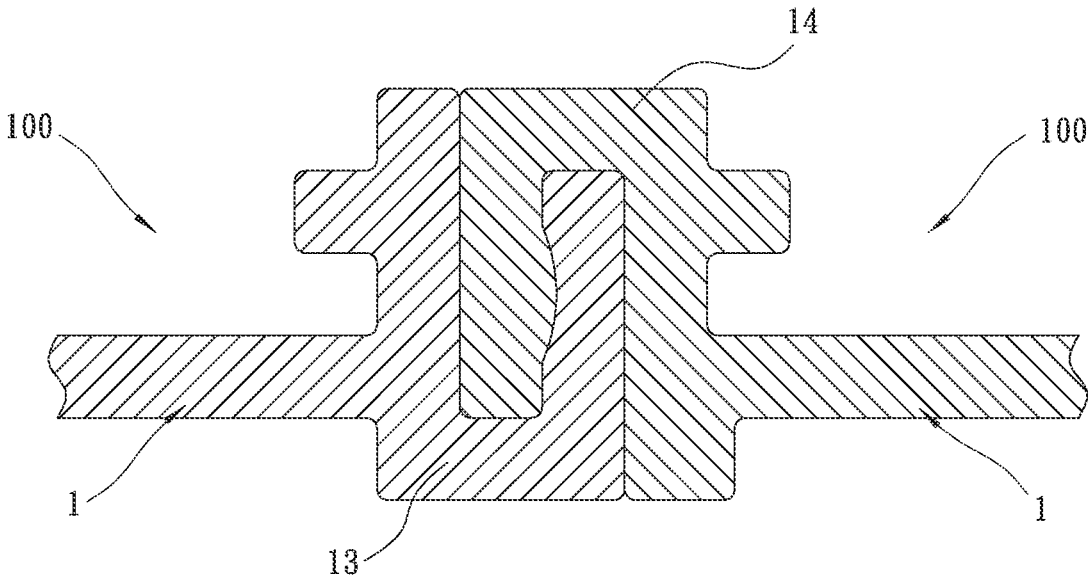
FIG. 7 is a partial cutaway schematic of the table when folded in accordance with some embodiments.

A first joint portion 13 is arranged at the longer side of the first plate body 11 distal to the connection between the first plate body 11 and the second plate body 12. A second joint portion 14 is arranged at the longer side of the second plate body 11 distal to the connection between the first plate body 11 and the second plate body 12. As shown in FIG. 7, the first joint portion 13 and the second joint portion 14 of the table 100 can combine with each other so that the table 100 is folded. In some embodiments, the first joint portion 13 and the second joint portion 14 are joined in a coalescing manner. However, the instant specification is not limited thereto and one of ordinary skill in the art would understand that other means for joining the first joint portion 13 and the second joint portion 14 exist.

The two matching frames 2 are arranged adjacent to the shorter sides of the first plate body 11 and the second plate body 12. Each matching frame 2 includes a first frame 21 and a second frame 22, which are arranged on a lower surface of first plate body 11 and a lower surface of the second plate body 12, respectively. The first frame 21 has a first retaining groove 23 adjacent to the short side of the first plate body 11, and the second frame 22 has a second retaining groove 24 adjacent to the short side of the second plate body 12.

Two foldable table legs 3 are arranged corresponding to the two matching frames 2. Each foldable table legs 3 includes a first support member 31 and a second support member 32. In some embodiments, the shape of the first support member 31 and the second support member 32 are similar or the same. However, the instant specification is not limited thereto. The first support member 31 includes a first U-shaped bolt 311, a first elastic C-shaped main body 312, and a first spring drum 313 integrally formed in this sequence. The second support member 32 includes a second U-shaped bolt 321, a second elastic C-shaped main body 322, and a second spring drum 323 integrally formed in this sequence. The first elastic C-shaped main body 312 passes through the first retaining groove 23 of the first frame 21, such that the first U-shaped bolt 311 and the first spring drum 313 are arranged adjacent to the connecting longer sides of the first plate body 11 and the second plate body 12. The second elastic C-shaped main body 322 passes through the second retaining groove 24 of the second frame 22, such that the second U-shaped bolt 321 and the second spring drum 323 are located adjacent to connecting longer sides of the first plate body 11 and the second plate body 12. The first U-shaped bolt 311 is inserted in the second spring drum 323, and the second U-shaped bolt 321 is inserted in the first spring drum 313.

Figure 3:
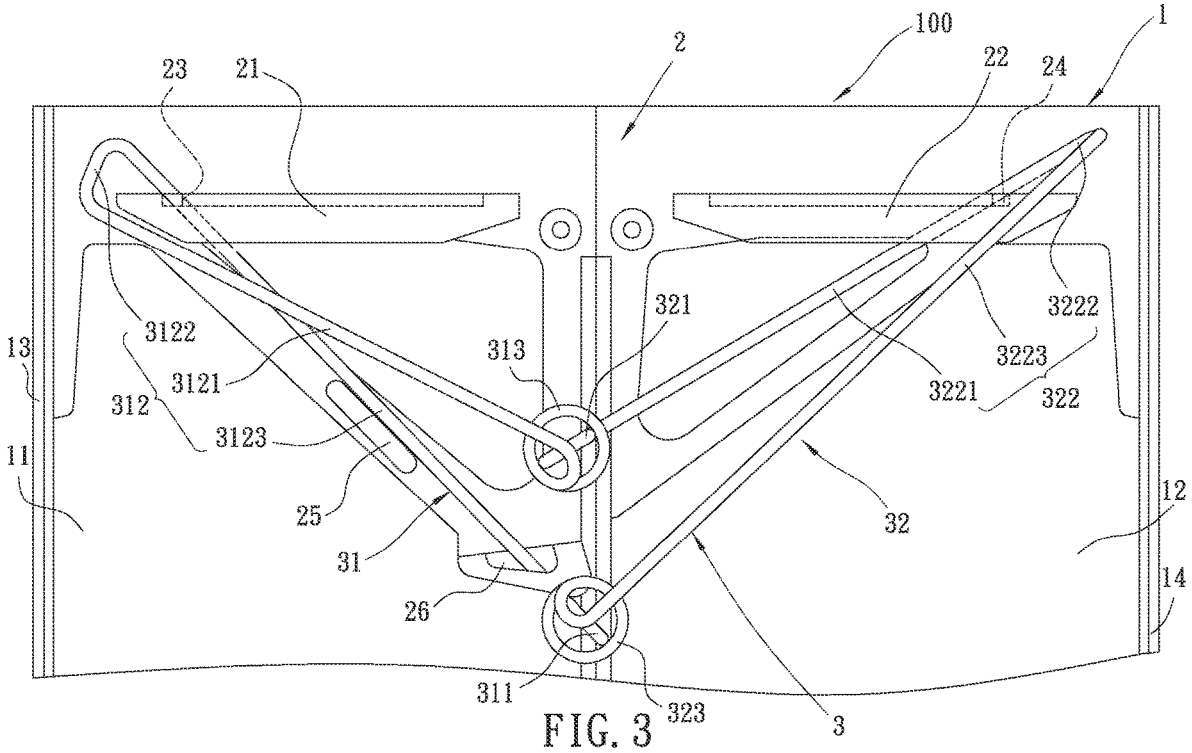
FIG. 3 is a partial bottom view schematic of the table structure in accordance with some embodiments.
Figure 4:
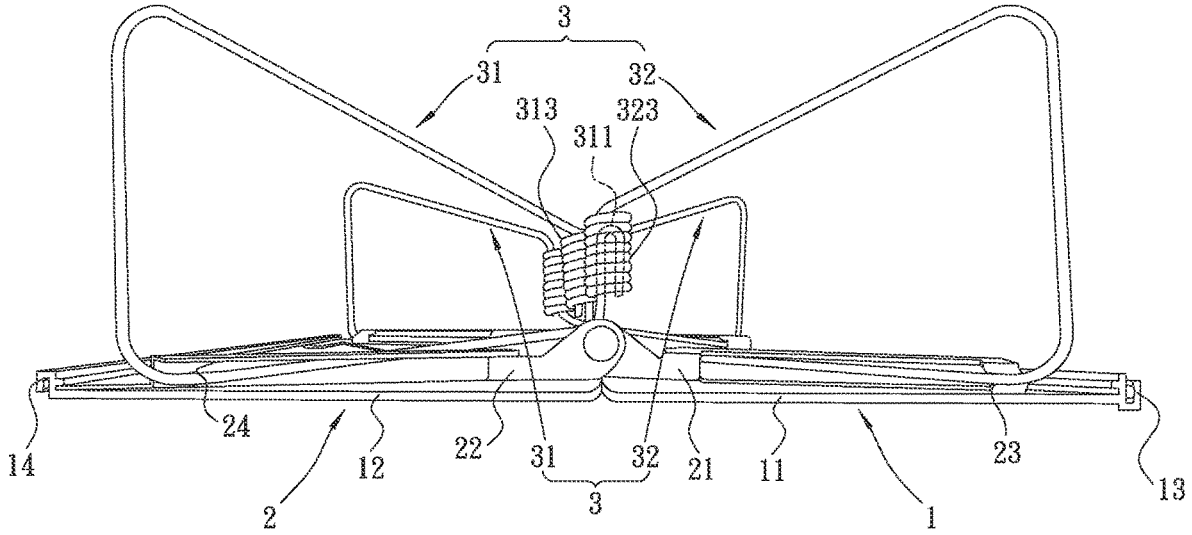
FIG. 4 is a side view schematic of the table structure in accordance with some embodiments.

Referring to FIG. 3, when the table 100 is expanded, the first plate body 11 and the second plate body 12 are substantially in the same plane. The first elastic C-shaped main body 312 of the first support member 31 of the legs 3 leans obliquely against of the first retaining groove 23 at the end distal to the connection between the first plate body 11 and the second plate body 12. The second elastic C-shaped main body 322 of the second support member 32 of the legs 3 leans obliquely against of the second retaining groove 24 at the end distal to the connection between the first plate body 11 and the second plate body 12. The table 100 is expanded by the elastic force between the first spring drum 313 and the second U-shaped bolt 321, as well as the elastic force between the second spring drum 323 and the first U-shaped bolt 311. The bottom portion of the first elastic C-shaped main body 312, the bottom portion of the second elastic C-shaped main body 322, as well as the first U-shaped bolt 311 inserted in the second spring drum 323 and the second U-shaped bolt inserted in the first spring drum 313 form three-point stabilization.

When the table 100 is folded (not shown in the Figures), the first plate body 11 is folded close to the second plate body 12, such that the first elastic C-shaped main body 312 moves toward a site on the first retaining groove 23 adjacent to the junction between the first plate body 11 and the second plate body 12 and that the entirety of the first elastic C-shaped main body 312 moves closer to the first plate body 11. Similarly, the second elastic C-shaped main body 322 moves toward a site on the second retaining groove 24 adjacent to the junction between the first plate body 11 and the second plate body 12. Furthermore, when the table 100 is folded, the first support member 31 and the second support member 32 are located between first frame 21 and second frame 22, and the first frame 21 and the second frame 22 are located between first plate body 11 and second plate body 12.

In some embodiments, the first frame 21 is substantially triangular. The first retaining groove 23 is arranged on the long leg of the triangle of the first frame 21. The short leg of the triangle of the first frame 21 is located adjacent to the junction of the first plate body 11 and the second plate body 12. A retaining block 25 is arranged on the hypotenuse of the triangle of the first frame 21, the retaining block 25 is configured to limit the movement of the C-shaped main body 312 of the first support member 31.

In some embodiments, the second frame 22 has a triangular shape like that of the first frame 21, and is configured in a mirrored manner with the first frame 21.

The first frame 21 has a position limiting cut-out 26 at where the first U-shaped bolt 311 inserted in the second spring drum 323. The first elastic C-shaped main body 312 passes through the position limiting cut-out 26 which limits the movement of the first elastic C-shaped main body 312.

Figure 5:
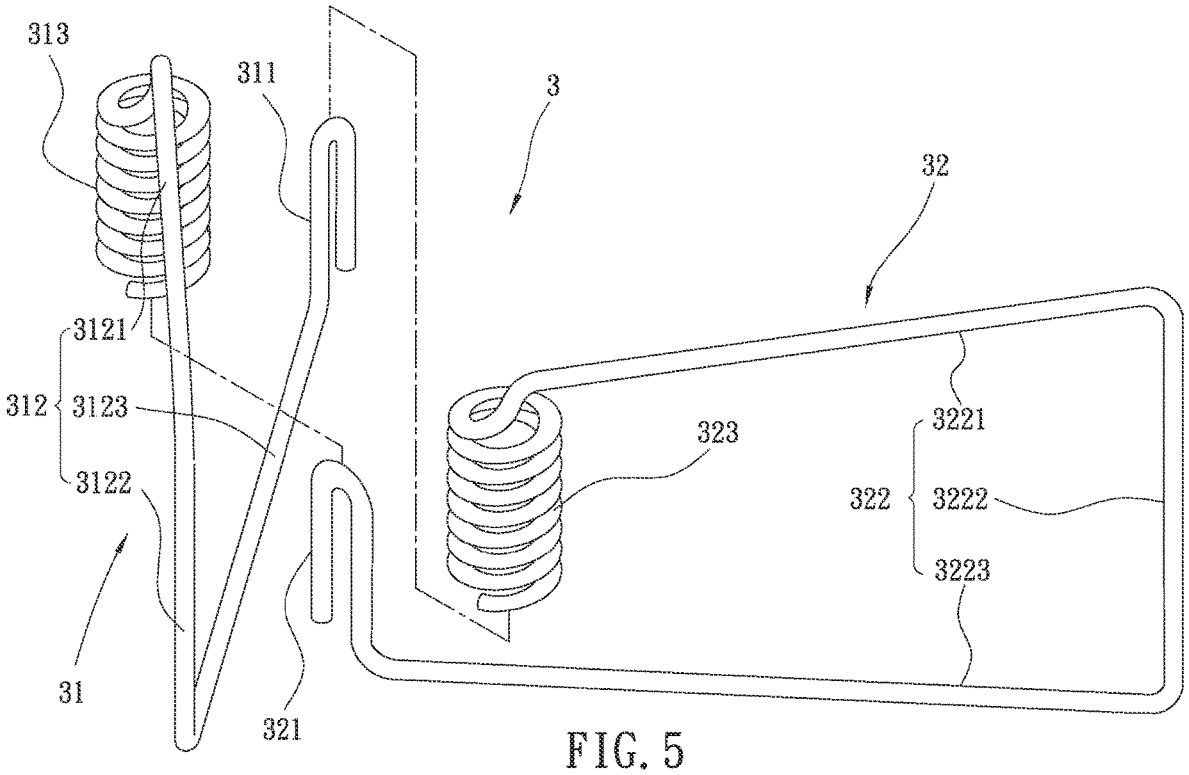
FIG. 5 is a schematic of the disassembled legs of the table structure in accordance with some embodiments.
Figure 6:
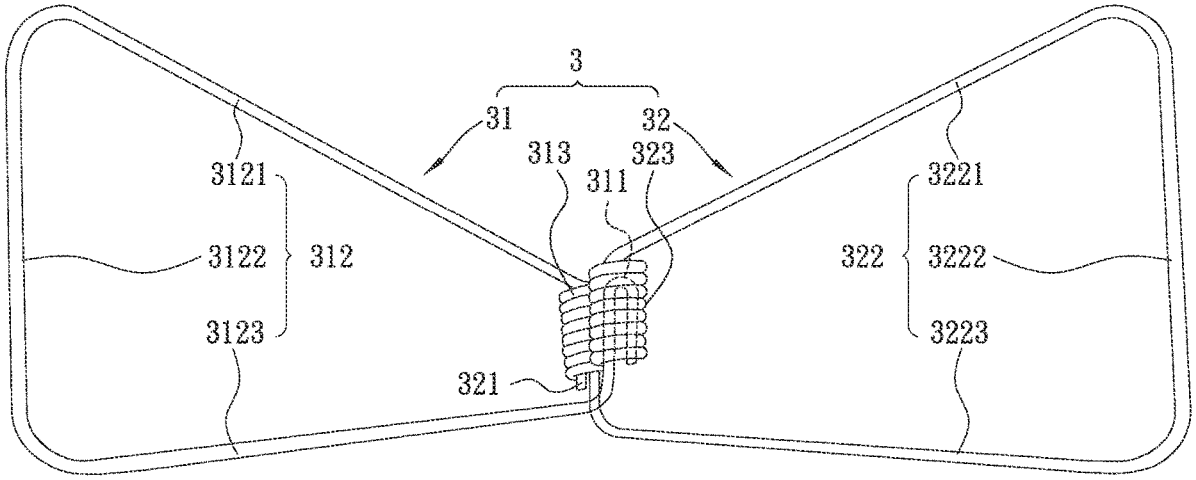
FIG. 6 is a schematic of the assembled legs of the table structure in accordance with some embodiments.

Referring to FIGS. 5 and 6, the first elastic C-shaped main body 312 of the first support member 31 has a first upper portion 3121, a first connector portion 3122, and a first lower portion 3123. The first upper portion 3121 is arranged close to the first plate body 11. The two ends of the first connector portion 3122 are angularly connected to the first upper portion 3121 and the first lower portion 3123, respectively. The end of the first upper portion 3121 distal to the first connector portion 3122 is connected to the first U-shaped bolt 311. The first U-shaped bolt 311 extends downward from the first upper portion 3121, so that the first U-shaped bolt 311 is substantially perpendicular to a lower surface of the first plate body 11. The end of the first upper portion 3121 adjacent to the connection with the first connector portion 3122 passes through the first retaining groove 23 and lean obliquely against the first retaining groove 23 at an end thereof distal to where the first plate body 11 and the second plate body 12 are joined when the table 100 is expanded. The end of the first lower portion 3123 distal to the first connector portion 3122 is connected to the first spring drum 313. The first spring drum 313 extends upward from the first lower portion 3123 so that the first spring drum 313 is substantially perpendicular to the lower surface of the first plate body 11.

In some embodiments of the instant specification, the first upper portion 3121 passes through the position limiting cut-out 26 at a site adjacent to the first U-shaped bolt 311 such that the movement of the first elastic C-shaped main body 312 is limited.

The second elastic C-shaped main body 322 of the second support member 32 includes a second upper portion 3221, a second connector portion 3222, and a second lower portion 3223. The second upper portion 3221 is arranged close to the second plate body 12. The two ends of the second connector portion 3222 are angularly connected to the second upper portion 3221 and the second lower portion 3223, respectively. The end of the second upper portion 3221 distal to the second connector portion 3222 is connected to the second U-shaped bolt 321. The second U-shaped bolt 321 extends downward from the second upper portion 3221 so that the second U-shaped bolt 321 is substantially perpendicular to the lower surface of the second plate body 12. The end of the second upper portion 3221 proximal to the connection with the second connector portion 3222 passes through the second retaining groove 24, and leans obliquely against the end of the second retaining groove 24 distal to where the first plate body 11 and the second plate body 12 are joined when the table 100 is expanded. The end of the second lower portion 3223 distal to the second connector portion 3222 is connected to the second spring drum 323. The second spring drum 323 extends upward from the second lower portion 3223 so that the second spring drum 323 is substantially perpendicular to the lower surface of the second plate body 12.

Referring to FIG. 3, the first U-shaped bolt 311 is inserted into the second spring drum 323, which is distal to the shorter side of the first plate body 11 and the second plate body 12. The second U-shaped bolt 321 is inserted into the first spring drum 313, which is proximal to the shorter side of the first plate body 11 and the second plate body 12. When the table 100 is in the expanded state, the first upper portion 3121 and the first lower portion 3123 of the first support member 31 cross each other, and the second upper portion 3221 of the second support member 32 does not cross the second lower portion 3223.

With the above structure, both the first support member 31 and the second support member 32 are integrally formed, and the two support members 31 and 32 are of similar or the same shape, which simplify the manufacture process and reduce the costs of manufacturing and material. Furthermore, the combination of the first support member 31 and the second support member 32 is by inserting the first U-shaped bolt 311 into the second spring drum 323 and inserting the second U-shaped bolt 321 into the first spring drum 313, which makes both assembly and disassembly easy. In addition, the elastic force between the first spring drum 313 and the second U-shaped bolt 321 and the elastic force between the second spring drum 323 and the first U-shaped bolt 311 can be harnessed when expanding the table 100, which makes the table 100 easily deployable without requiring excessive force. Furthermore, the bottom portion of first elastic C-shaped main body 312, the bottom portion of the second elastic C-shaped main body 322, as well as the first U-shaped bolt 311 inserted in the second spring drum 323 and the second U-shaped bolt 321 inserted in the first spring drum 313 forms three-point stabilization, resulting in a stable when the table 100 is expanded.

In addition, the configuration in which the first joint portion 13 of the first plate body 11 and the second joint portion 14 of the second plate body 12 are joinable allows the first joint portion 13 and the second joint portion 14 to be joined by, for example, coalescing, thereby resulting in a stably folded table.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

INSTANT TABLE STRUCTURE THAT ALLOWS FOLDING TABLES TO BE EXPANDED AND STABLY FOLDED—FIGS. 3-7

100 Foldable Table
1 Table top plate
11 First plate body
12 Second plate body
13 First joint portion
14 Second joint portion
2 Matching frames
21 First frame
22 Second frame
23 First retaining groove
24 Second retaining groove
25 Retaining block
26 Position limiting cut-out
3 Foldable table legs
31 First support member
311 First U-shaped bolt
312 First elastic C-shaped main body
3121 First upper portion
3122 First connector portion
3123 First lower portion
313 First spring drum
32 Second support member
321 Second U-shaped bolt
322 Second elastic C-shaped main body
3221 Second upper portion
3222 Second connector portion
3223 Second lower portion
323 Second spring drum

DESIGN DESCRIBED IN REFERENCE—FIGS. 1 AND 2

10' Table top plate
11' Rectangular plate body
13' Convex ribs
20' Folding brackets
21' First iron piece
211' Inner folding side plate
212' Long position-limiting groove
213' Position-limiting sliding side
214' Inner top plate
215' Short position-limiting groove
216' Top end
217' Oblique guide edge
218' Position-limiting plate
22' Second iron piece
221' Outer folding side plate
222' Long position-limiting groove
223' Position-limiting sliding side
23' Rotation shaft portion
30' Support unit
31' First leg
311' First standing rod
312' Second standing rod
313' Combination connecting rod
314' Combination sleeve
32' Second leg
321' First standing rod
322' Second standing rod
323' Combination connecting rod
324' Combination sleeve

What is claimed is:

1. A foldable table, comprising:

a table top plate, wherein the table top plate comprises a first plate body and a second plate body are connected to each other and are configured to be folded in relative to each other, wherein the first plate body and the second plate body are substantially rectangular, wherein the first plate body and the second plate body have two shorter sides and two longer sides, and wherein a first longer side of the first plate body and a first longer side of the second plate body are in proximity to each other;

two matching frames, wherein each matching frame of the two matching frames comprises a first frame and a second frame, wherein the first frame is below the first plate body and in proximity to a first shorter side of the first plate body, wherein the second frame is below the second plate body and in proximity to a first shorter side of the second plate body, wherein the first frame has a first retaining groove on a site thereof adjacent to the first shorter side of the first plate body, and wherein the second frame has a second retaining groove on a site thereof adjacent to the first shorter side of the second plate body; and two foldable table legs, wherein each foldable table leg of the two foldable table legs corresponds to one of the two matching frames, wherein each foldable table leg comprises a first support member and a second support member, wherein the first support member comprises a first U-shaped bolt, a first elastic C-shaped main body, and a first spring drum integrally formed in this sequence, wherein the second support member comprises a second U-shaped bolt, a second elastic C-shaped main body, and a second spring drum integrally formed in this sequence, wherein the first elastic C-shaped main body passes through the first retaining groove of the first frame such that the first U-shaped bolt and the first spring drum are in proximity to the first longer side of the first plate body and the first longer side of the second plate body, wherein the second elastic C-shaped main body passes through the second retaining groove of the second frame such that the second U-shaped bolt and the second spring drum are in proximity to the first longer side of the first plate body and the first longer side of the second plate body, and wherein the first U-shaped bolt is inserted in the second spring drum, and the second U-shaped bolt is inserted in the first spring drum, wherein, when the foldable table is in an expanded state, the first plate body and the second plate body are substantially in the same plane, the first elastic C-shaped main body of the first support member leans obliquely against the first retaining groove at an end of the first elastic C-shaped main body distal to a junction between the first plate body and the second plate body, the second elastic C-shaped main body of the second support member leans obliquely against the second retaining groove at an end of the second support member distal to the junction between the first plate body and the second plate body, the foldable table is kept in the expanded state by an elastic force between the first spring drum and the second U-shaped bolt and by an elastic force between the second spring drum and the first U-shaped bolt, and a bottom portion of the first elastic C-shaped main body, a bottom portion of the second elastic C-shaped main body, as well as the first U-shaped bolt inserted in the second spring drum and the second U-shaped bolt inserted in the first spring drum forms three-point stabilization, and wherein, when the foldable table is in a folded state, the first plate body leans against the second plate body, the first elastic C-shaped main body is moved toward an end of the first retaining groove proximal to the junction between the first plate body and the second plate body and leans against the first plate body, the second elastic C-shaped main body is moved toward an end of the second retained groove proximal to the junction between the first plate body and the second plate body and leans against the second plate body, the first support member and the second support member are between the first frame and the second frame, and the first frame and the second frame are between the first plate body and the second plate body.

2. The foldable table of claim 1, wherein the first plate body comprises a first joint portion at a second longer side of the first plate body, the second plate body comprises a second joint portion at a second longer side of the second plate body, and the first joint portion and the second joint portion are configured to join with each other to keep the table in the folded state.

3. The foldable table of claim 2, wherein the first joint portion and the second joint portion are configured to join with each other in a coalescing manner.

4. The foldable table of claim 1, wherein the first frame is substantially triangular, the first retaining groove is located on a longer leg of the triangle, the shorter leg of the triangle is in proximity with the junction between the first plate body and the second plate body, the first frame has a retaining block on a hypotenuse of the triangle, and the retaining block is configured to limit a movement of the first elastic C-shaped main body.

5. The foldable table of claim 1, wherein the first frame has a position limiting cut-out in proximity to where the first U-shaped bolt inserted in the second spring drum, and the first elastic C-shaped main body passes through the position limiting cut-out which limits a movement of the first elastic C-shaped main body.

6. The foldable table of claim 5, wherein the first elastic C-shaped main body of the first support member comprises a first upper portion, a first connector portion, and a first lower portion, the first upper portion is in proximity to the first plate body, the first connector portion is angularly connected to the first upper portion at a first end of the first connector portion and is angularly connected to the first lower portion at a second end of the first connector portion, the first upper portion is connected with the first U-shaped bolt at an end of the first upper portion distal to a connection with the first connector portion, the first U-shaped bolt extends downward from the first upper portion such that the first U-shaped bolt is substantially perpendicular to the lower surface of the first plate body, the first upper portion passes through the first retaining groove at an end of the first upper portion proximal to the first connector portion, and leans obliquely against the first retaining groove at an end of the first retaining groove distal to the junction between the first plate body and the second plate body when the foldable table is in the expanded state, the first lower portion is connected to the first spring drum at an end of the first lower portion distal to the first connector, the first spring drum extends upward from the first lower portion such that the first spring drum is substantially perpendicular to the lower surface of the first plate body, and the first upper portion passes through the position limiting cut-out at a site of the first upper portion proximal to the first U-shaped bolt.

7. The foldable table of claim 1, wherein the first U-shaped bolt is inserted in the second drum at a first location, the second U-shaped bolt is inserted in the first drum at a second location, and the first location is distal to the first shorter sides of the first plate body and the second plate body in relative to the second location.

8. The foldable table of claim 1, wherein the first elastic C-shaped main body of the first support member comprises a first upper portion, a first connector portion, and a first lower portion, the first upper portion is in proximity to the first plate body, the first connector portion is angularly connected to the first upper portion at a first end of the first connector portion and is angularly connected to the first lower portion at a second end of the first connector portion, the first upper portion is connected to the first U-shaped bolt at an end of the first upper portion distal to a connection with the first connector portion, the first U-shaped bolt extends downward from the first upper portion such that the first U-shaped bolt is substantially perpendicular to a lower surface of the first plate body, the first upper portion passes through the first retaining groove at an end of the first upper portion proximal to the first connector portion, and leans obliquely against the first retaining groove at an end of the first retaining groove distal to the junction between the first plate body and the second plate body when the foldable table is in the expanded state, the first lower portion is connected to the first spring drum at an end of the first lower portion distal to the first connector portion, and the first spring drum extends upward from the first lower portion such that the first spring drum is substantially perpendicular to the lower surface of the first plate body.

9. The foldable table of claim 8, wherein the second elastic C-shaped main body of the second support member comprises a second upper portion, a second connector portion, and a second lower portion, the second upper portion is in proximity to the second plate body, the second connector portion is angularly connected to the second upper portion at a first end of the second connector portion and is angularly connected to the second lower portion at a second end of the second connector portion, the second upper portion is connected to the second U-shaped bolt at an end of the second upper portion distal to a connection with the second connector portion, the second U-shaped bolt extends downward from the second upper portion such that the second U-shaped bolt is substantially perpendicular to a lower surface of the second plate body, the second upper portion passes through the second retaining groove at an end of the second upper portion proximal to the second connector portion, and leans obliquely against the second retaining groove at an end of the second retaining groove distal to the junction between the first plate body and the second plate body when the foldable table is in the expanded state, the second lower portion is connected to the second spring drum at an end of the second lower portion distal to the second connector portion, and the second spring drum extends upward from the second lower portion such that the second spring drum is substantially perpendicular to the lower surface of the second plate body.

10. The foldable table of claim 9, wherein, when viewing from a lower side of the foldable table, the first upper portion and the first lower portion of the first support member cross each other, and the second upper portion and the second lower portion of the second support member do not cross each other when the foldable table is in the expanded state.

* * * * *